US005714844A

United States Patent [19]

Sato

[11] Patent Number: 5,714,844

[45] Date of Patent: Feb. 3, 1998

[54] DISPLAY-PANEL DRIVE CIRCUIT

[75] Inventor: Toshimi Sato, Kawasaki, Japan

[73] Assignee: Texas Instruments Incorporated, Dallas, Tex.

[21] Appl. No.: 405,659

[22] Filed: Mar. 17, 1995

[30] Foreign Application Priority Data

Mar. 17, 1994 [JP] Japan ..... 6-047266

[51] Int. Cl.[6] ..... G09G 5/00

[52] U.S. Cl. ..... 315/169.4; 315/169.3; 313/585; 313/586; 345/211; 345/212

[58] Field of Search ..... 315/169.4, 169.3; 345/208, 60, 68, 61, 204, 211, 212, 215; 326/80

[56] References Cited

U.S. PATENT DOCUMENTS 5,032,829 7/1991 Shoji et al. ..... 345/212 X 5,446,344 8/1995 Kanazawa ..... 315/169.4

*Primary Examiner*—Robert Pascal
*Assistant Examiner*—Arnold Kinkead
*Attorney, Agent, or Firm*—Richard L. Donaldson; William B. Kempler

[57] ABSTRACT

A type of display-panel drive circuit that reduces the power rating in the IC section so the circuit can be formed using IC. A level shift circuit converts a signal S2 from high level to low level or from low level to high voltage level $V_H$ and outputs it as S2'. A first transistor XSC connects an output terminal HVO1 to ground when signal S2 is high level. A second transistor XSU remains nonconductive when the output of the level shift circuit is low level but connects an external signal input terminal VSU to output terminal HVO1 when the output of the level shift circuit is at high voltage level $V_H$. A third transistor XSD connects an external signal input terminal VSD to output terminal HVO1 when signal S3 is low level and signal S3' is high level but remains nonconductive when both S3 and S3' are low level.

6 Claims, 6 Drawing Sheets

FIG. 2
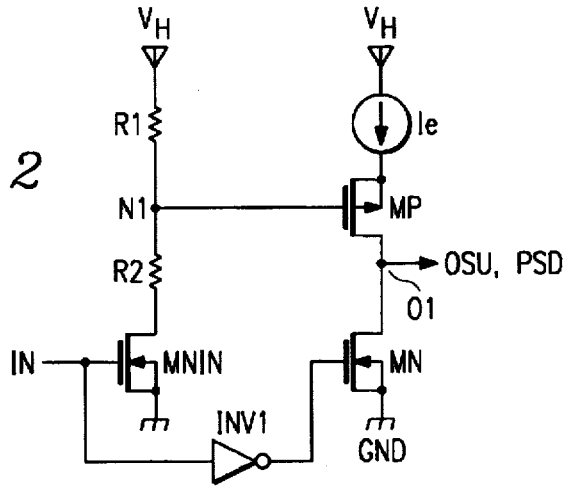
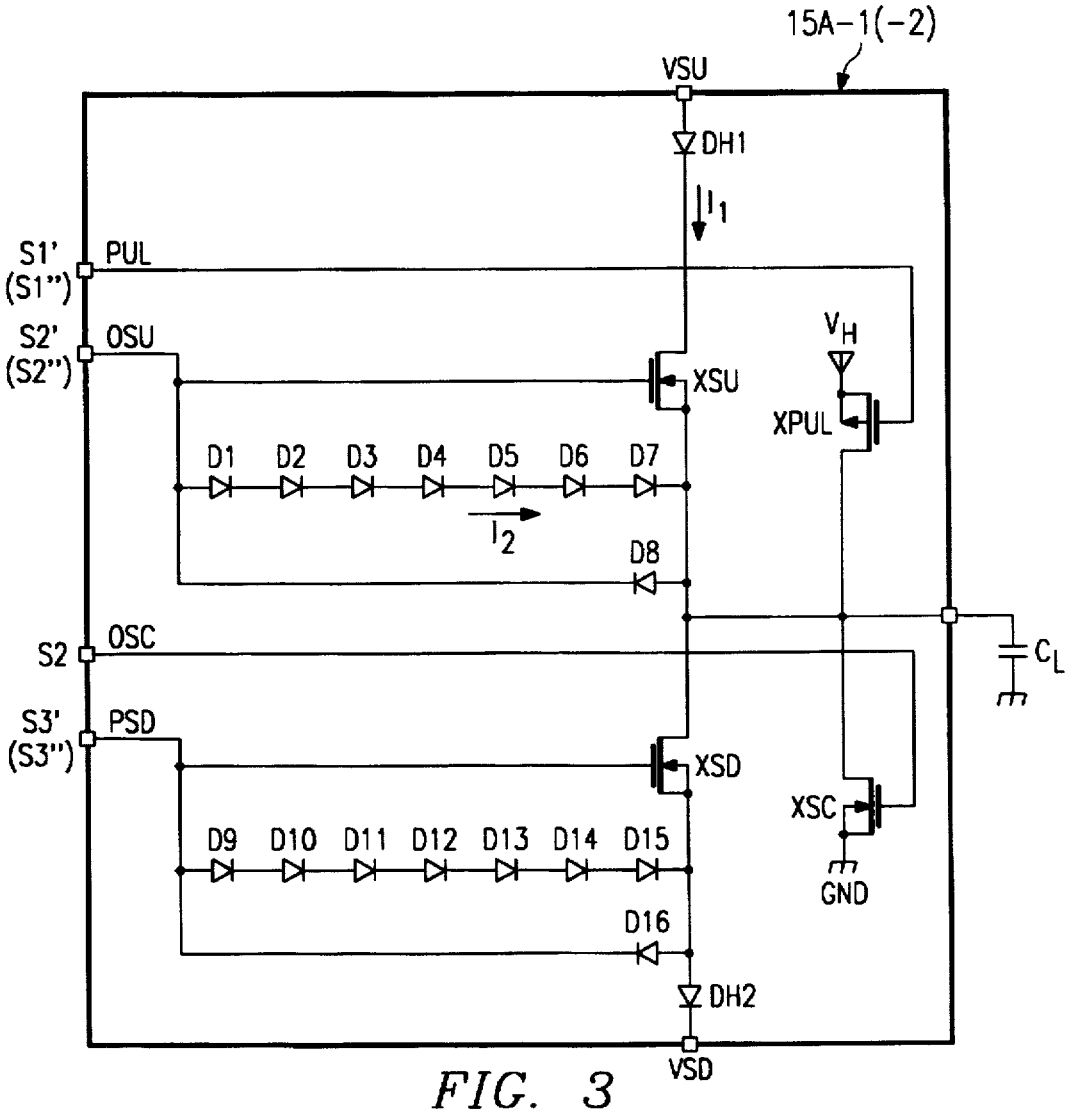
FIG. 3

DISPLAY-PANEL DRIVE CIRCUIT

FIELD OF THE INVENTION

This invention concerns a drive circuit for plasma or other display panels.

BACKGROUND OF THE INVENTION

Plasma displays operate by plasma discharge. The display is driven by applying an anode/auxiliary anode voltage and a cathode voltage at prescribed levels to cells arranged in a matrix.

During the driving operation, first a discharge is started, for example, by applying an anode voltage of 60 V and a cathode voltage of −280 V for a prescribed period T1. After one discharge cycle is performed, for subsequent cycles, a discharge-maintaining voltage smaller than the starting voltage in the first cycle is applied. More specifically, a cathode voltage alone is applied every prescribed period, for example, every 4 μsec.

FIG. 8 illustrates a conventional drive circuit used for the cathode electrodes of a conventional DC-type plasma display panel, made of discrete ICs. It consists of the following parts: input buffer circuits B1–B8; shift register circuits (SFR) 11*a*-1, 11*a*-2, . . . , 11*b*-1, 11*b*-2, . . . ; latch circuits (LTC) 12*a*-1, 12*a*-2, . . . , 12*b*-1, 12*b*-2, . . . ; gate circuits 13-1 and 13-2; level shift circuits (L/S) 14-1, 14-2, . . . ; buffer circuits BP1, BP2, . . . , BN1, BN2, . . . ; and PMOS transistors PT1, PT2, . . . , as well as NMOS transistors NT1, NT2, . . . which are connected in series and used for constituting the drive circuit.

In addition, in FIG. 8, HVO1 and HV02 are output terminals; GND is a ground potential; $V_{DD}$ is a power source voltage; and $V_H$ is a high power source voltage.

The input buffer B1 connects to the input of data signal D1, and its output connects to the input IN of shift register circuit 11*a*-1. The output terminal OUT of shift register circuit 11*a*-1 connects to the input IN of shift register circuit 11*a*-2. The input of input buffer circuit B2 connects to the input of clock signal CKD1, and its output connects to the clock input terminals CK of shift register circuits 11*a*-1, 11*a*-2, etc.

The input of input buffer circuit B3 connects to the input of data signal D2, and its output connects to the input terminal IN of shift register circuit 11*b*-1. The output OUT of shift register circuit 11*b*-1 connects to the input terminal IN of shift register circuit 11*b*-2. The input of buffer B4 connects to the input terminal clock signal CKD2, and its output connects to the clock input terminals CK of shift register circuits 11*b*-1, 11*b*-2, etc.

The outputs of shift register 11*a*-1, 11*b*-1, 11*a*-2, and 11*b*-2 connect to the inputs of respective latch circuits 12*a*-1, 12*b*-1 12*a*-2, and 12*b*-2.

The input of buffer B5 connects to the input terminal of signal LED1, and its output connects to the control terminals LE of latch circuits 12*a*-1 and 12*a*-2. The input of buffer B6 connects to the input of signal LED2, and its output connects to the control terminals LE of latch circuits 12*b*-1 and 12*b*-2.

The input of buffer B7 connects to input signal T1, and its output connects to one input of 2-input AND circuit 131 in gate circuit 13-1 and connected to one input of 2-input AND circuit 131 in gate circuit 13-2. The input buffer B8 connects to input signal T2, and its output connects to one input of 2-input AND circuit 132 in gate circuit 13-1 and connects to one input of two-input AND circuit 132 in gate circuit 13-2.

In gate circuit 13-1, the other input of AND circuit 131 connects to the output of latch circuit 12*a*-1, and the other input of AND circuit 132 connects to the output of latch circuit 12*b*-1. The outputs of AND circuits 131 and 132 connect to the two inputs of OR circuit 133, whose output connects to the input IN of level shift circuit 14-1.

In gate circuit 13-2, the other input of AND circuit 131 connects to the output of latch circuit 12*a*-2, and the other input of AND circuit 132 connects to the output of latch circuit 12*b*-2. The outputs of AND circuits 131 and 132 connects to the two inputs of OR circuit 133, whose output connects to the input IN of level shift circuit 14-2.

Both level shift circuits 14-1 and 14-2 have two output terminals O1 and O2. When a high-level signal is input to input IN, high-level signals almost equal to the power source voltages of buffer circuits BP1 and BN1, are output from terminals O1 and O2.

Output O1 of level shift circuit 14-1 connects to the gate of PMOS transistor PT1 through buffer BP1, and output O2 connects to the gate of NMOS transistor NT1 through buffer BN1.

Similarly, output O1 of level shift circuit 14-2 connects to the gate of PMOS transistor PT2 through buffer BP2, and output terminal O2 connects to the gate of NMOS transistor NT2 through buffer BN2.

As described in the above, in the display-panel drive circuit made of conventional driver ICs, two shift register circuits 11*a* and 11*b*, two latch circuits 12*a* and 12*b*, gate circuit 13, level shift circuit 14, buffer circuits BP and BN, as well as drive circuits PT and NT are set up with respect to one output terminal HVO.

FIG. 9 illustrates the timing between various input signals to the conventional circuit of FIG. 8 and the signal levels at output terminals HVO1 and HVO2. The circuit is driven by two data signals D1 and D2 having different timing. Signals D1 and D2 determine which output terminal HVO is set ON (ground level). The data signals are serial/parallel converted by shift register circuits 11*a* and 11*b* and latch circuits 12*a* and 12*b*.

The data is transmitted depending on clock signals CKD1 and CKD2 which are respectively sent to shift register circuits 11*a* and 11*b*, respectively. Then, the data is held in latch circuits 12*a* and 12*b*, based on respective input signals LED1 and LED2.

In gate circuit 13, logic operation is performed at timing for which signals T1 and T2 are set on the high levels. Through level shift circuit 14, the voltages fed to the gates of PMOS transistor PT and NMOS transistor NT in the drive circuit are controlled corresponding to the data states of the data signals D1 and D2. Then, a prescribed pulse signal is output from output terminal HVO.

As illustrated in FIG. 9, for the circuit shown in FIG. 8, the pulse signals output from output terminals HVO1 and HVO2 have a prescribed phase difference PHD from each other, which is equal to the period of signals T1 and T2.

Usually, the waveform output based on signal T1 is called scan pulse, and the waveform output based on signal T2 is called holding pulse.

However, the power rating of the conventional circuit is high, making formation of an IC is difficult.

For example, for the circuit shown in FIG. 8, if the frequency is f, and the capacitive load is $C_L$, the power rating $P_{CL}$ with respect to the capacitive load is:

$$P_{CL}=f\times C_L\times V^2 \quad (1)$$

Therefore, if f equals 250 KHz, $C_L$ is 120 pF, and voltage is 100 V, and one IC has 32 HVO output terminals HVO1–HV032, the power rating is:

$$P_{CL32}=250K\times120\ p\times100^2\times32=9.6\ (W) \quad (2)$$

But the power rating of a driver IC is limited to about 2 W due to package's restriction, etc. Consequently, for such values it is difficult to realize the drive circuit in an IC.

This invention solves this problem by providing a novel display-panel drive circuit of reduced power rating for the integrated circuits so that it is possible to form it as an IC.

The novel drive circuit has a first shift register group of multiple shift registers which shift a first pulse signal in sequence corresponding to a first clock signal and a second shift register group of multiple shift registers which shift a second pulse signal in sequence corresponding to a second clock signal. A first transistor group connects the output terminals of an output terminal group to a first reference potential in response to the outputs of the shift registers of the first shift register group. A second transistor group takes the complement of the first shift register group and connects the output terminals of the output terminal group to a first terminal.

A third transistor group connects the output terminals of the output terminal group to a second terminal in response to the outputs of the second shift register group. Then a first transistor connects the second terminal to the first reference potential in response to a third pulse signal, and a second transistor takes the complement of the first transistor and responsively connects the first terminal to a second reference potential.

The display-panel drive circuit of this invention can have a fourth transistor group of multiple transistors which connect the output terminals of the output terminal group to the second reference potential when the first and third transistor groups are nonconductive.

The output terminals of the output terminal group can be connected to various cathode electrodes of a plasma display panel. By making the transistors in the first transistor group conductive, scan pulses having a prescribed phase difference are applied to the cathode electrodes. In addition, by making the second transistor conductive, holding pulses having a prescribed phase difference are applied to the cathode electrodes.

For the display-panel drive circuit of this invention, the first shift register group, the second shift register group, the first transistor group, the second transistor group, the third transistor group, and the fourth transistor group are all formed in the same semiconductor IC device.

When the first drive pulse is output from each output terminal of the output terminal group, the transistor of the first transistor group corresponding to the output terminal becomes conductive, and the first reference potential (ground potential) is output from the output terminal. At this time, the transistor of the second transistor group corresponding to the output terminal is in the nonconductive state. On the other hand, if the second drive pulse is output from each output terminal of the output terminal group, when the transistor of the third transistor group corresponding to the output terminal is in the conductive state, the first transistor becomes conductive, and the first reference potential is output from the output terminal.

The transistors of the second transistor group become conductive when the transistors of the first transistor group corresponding to them are in the conductive state. By making the second transistor conductive, the second reference potential (power source potentials) is output from each output terminal of the output terminal group.

When neither the first drive pulse nor the second drive pulse is output from the output terminal of the output terminal group, the transistor of the fourth transistor group outputs the second reference potential from each output terminal of the output terminal group. That is, it is possible to prevent the output terminal from becoming floating when the transistor in the first transistor group and the transistor in the third transistor group corresponding to each output terminal in the output terminal group, as well as the second transistor, are in the nonconductive state.

The first drive pulse is a scan pulse applied to each cathode electrode of a DC drive plasma display, and the second drive pulse is a holding pulse. These drive pulses are applied to various cathode electrodes, respectively, with a phase difference from each other.

Since most of the display-panel drive power is supplied by the first transistor and on the second transistor, it is possible to form other circuit elements using semiconductor integrated circuit units (IC). Consequently, the assembly area of the display-panel drive circuit becomes small.

BRIEF DESCRIPTION OF THE DRAWINGS

FIG. 2 is a circuit diagram of an embodiment of a level shift circuit for converting logic level input signals (GND-$V_{DD}$) into full amplitude (GND-$V_H$) signals.

FIG. 3 is a circuit diagram of an embodiment of an output circuit for this invention.

EXPLANATION OF PARTS IN THE FIGURES

1A, IC portion;
B1–B8 input buffer circuits;
**11*a*-1, 11*a*-2, 11*b*-1, 11*b*-2**, shift register circuits;
**12*a*-1, 12*a*-2, 12*b*-1, 12*b*-2**, latch circuits;
13A-1, 13A-2, gate circuits;
14A-11-14A-13, 14A-21 - 14A-23, 14B, 14C, level shift circuits;
15A-1, 15A-2, 15B, output circuits;
HVO1, HVO2, output terminals;
2A discrete portion;
21 level shift circuit;
BP21, BN21, buffer circuit;
EXP21, PMOS transistor; and
EXN21, NMOS transistor.

Although the invention has been described with reference to embodiments, this description is not be construed in a limiting sense. Various modifications of the disclosed embodiments will become apparent to persons skilled in the art upon reference to this description. It is contemplated that the appended claims will cover any such modifications or embodiments as fall within the true scope of the invention.

DESCRIPTION OF THE PREFERRED EMBODIMENTS

Figure 1:
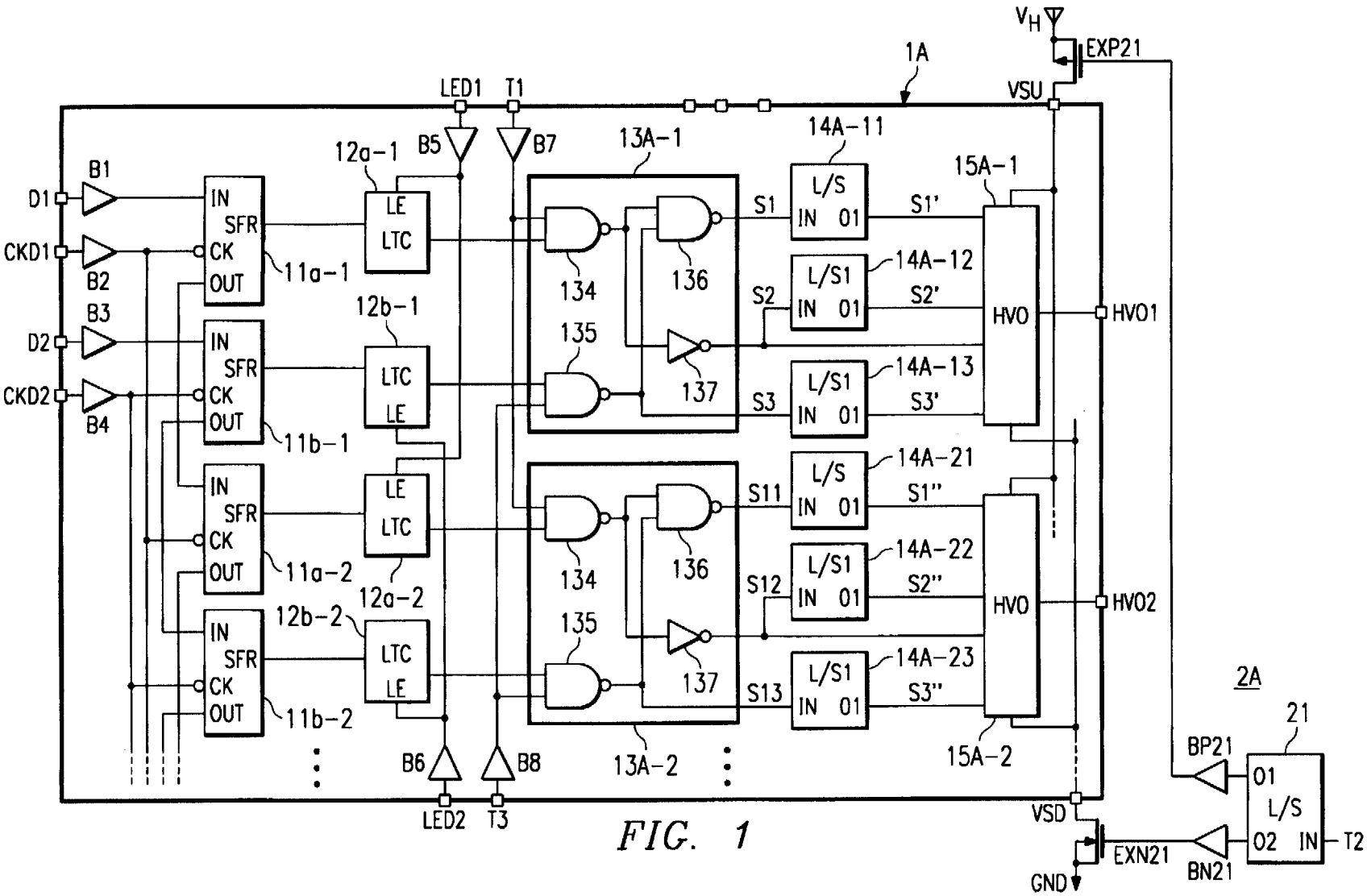
FIG. 1 is a circuit diagram of an embodiment of a display-panel drive circuit according to the invention.

FIG. 1 is a circuit diagram illustrating an application example of the display-panel drive circuit of this invention.

Figure 8:
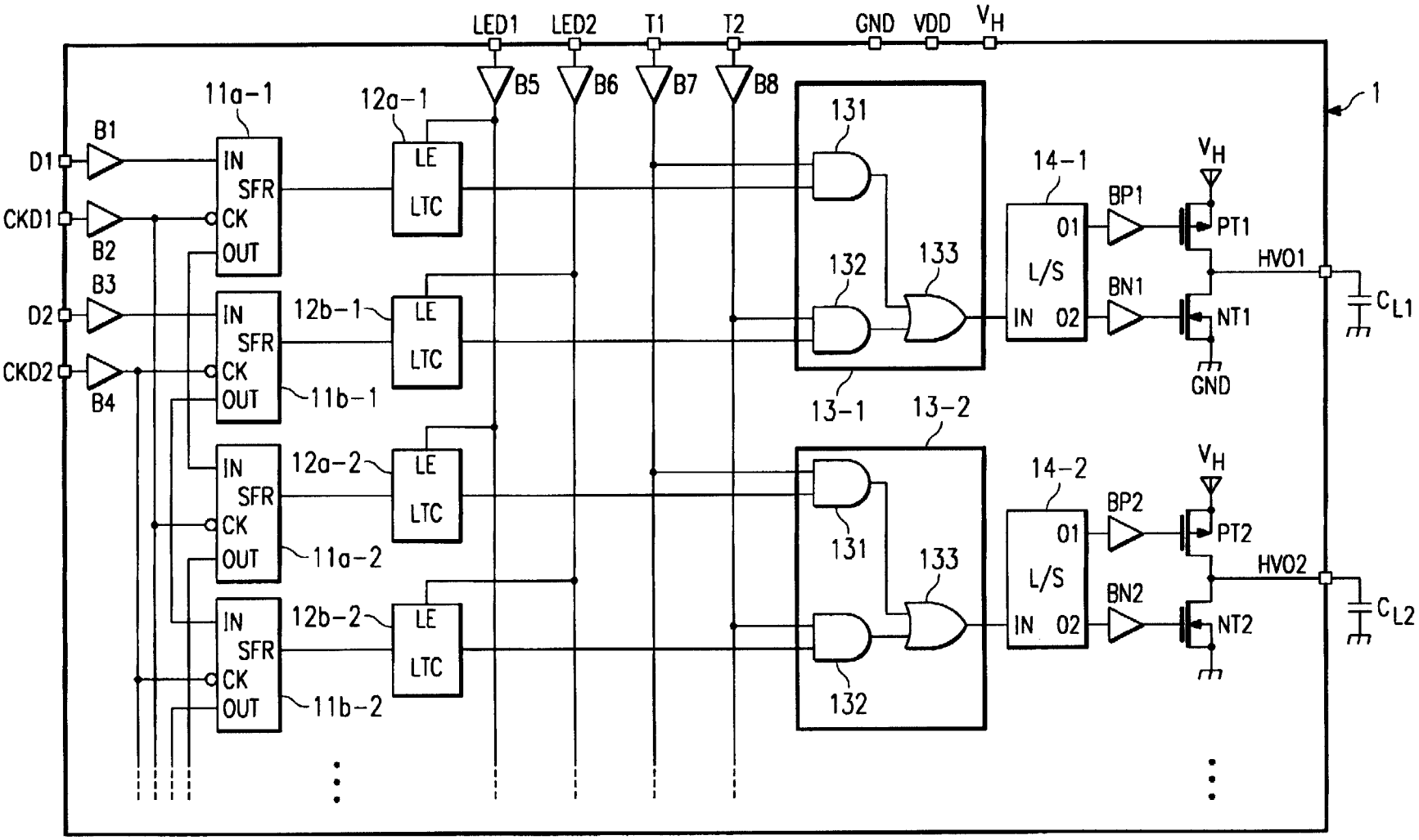
FIG. 8 (PRIOR ART)
FIG. 8 is a circuit diagram of a conventional display-panel drive circuit.
Figure 9:
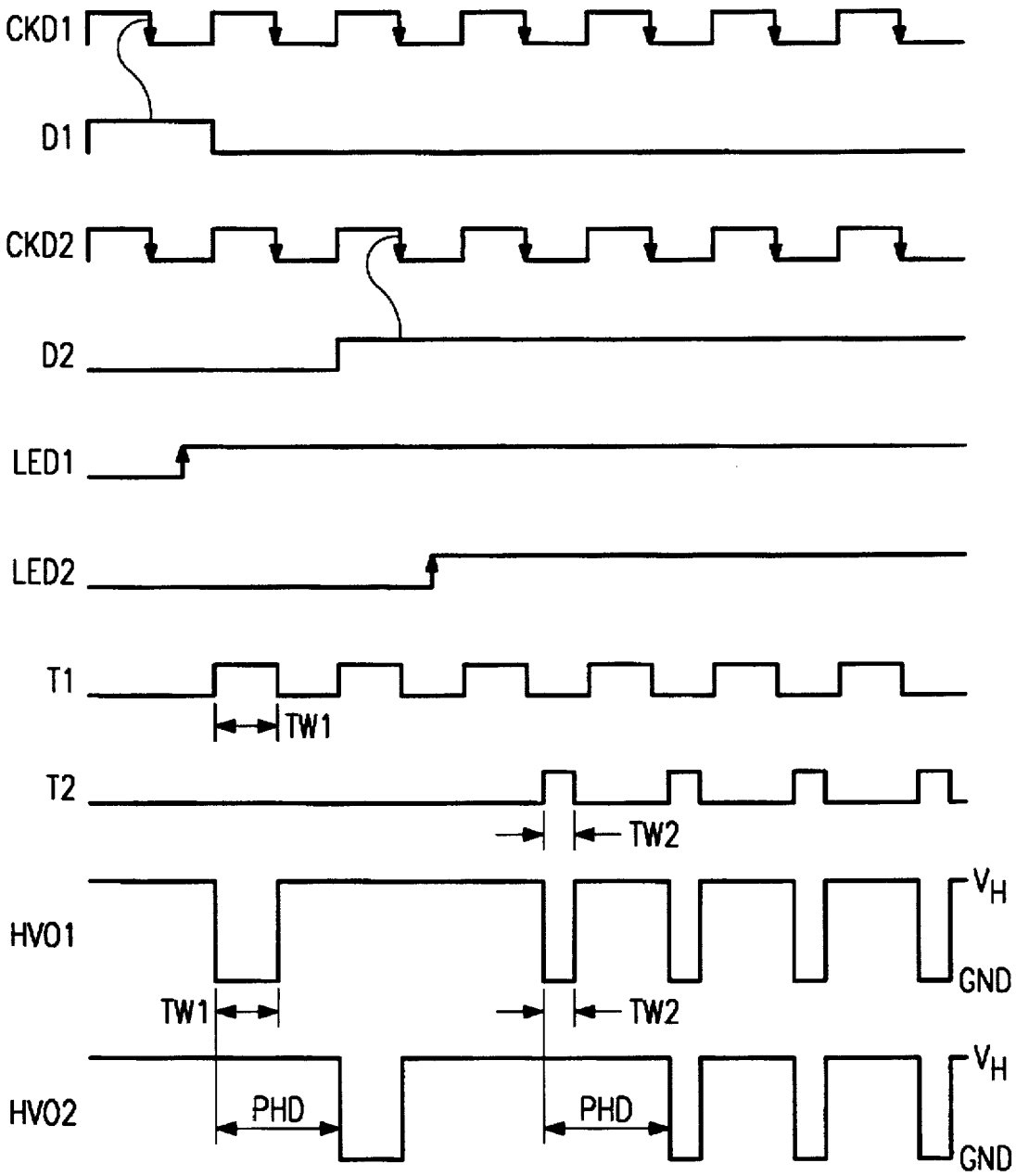
FIG. 9 is a timing chart for the conventional circuit of FIG. 8.

In this figure, the same components as those in FIG. 8 illustrating the conventional example have the same symbols.

1A represents the IC portion; 2A represents the discrete portion; B1–B8 represent input buffer circuits; 11*a*-1, 11*a*-2, . . . , 11*b*-1, 11*b*-2, etc. represent shift register circuits (SFR); 12*a*-1, 12*a*-2, . . . , 12*b*-1, 12*b*-2, etc. latch circuits (LTC); 13A-1, 13A-2, etc. represent gate circuits; 14A-11, 14A-21, . . . , 14A-12, 14A-22, . . . , 14A-13, 14A-23, etc. represent level shift circuits; 15A-1, 15A-2, etc. represent output circuits (HVO); BP21 and BN21 represent buffer circuits; EXP21 represents a PMOS transistor; EXN21 represents an NMOS transistor; HVO1 and HVO2 represent output terminals; GND represents a ground potential; $V_{DD}$ represents a power source voltage; and $V_H$ represents a high power source voltage.

The IC section 1A consists of input buffer circuits B1–B8, shift register circuits 11*a*-1, 11*a*-2, . . . , 11*b*-1, 11*b*-2, etc., latch circuits 12*a*-1, 12*a*-2, . . . , 12*b*-1, 12*b*-2, etc., gate circuits 13A-1, 13A-2, etc., level shift circuits 14A-11, 14A-21, . . . , 14A-12, 14A-22, . . . , 14A-13, 14A-23, etc., and output circuits 15A-1, 15A-2, etc.

The following elements are arranged with respect to one output terminal HVO: two shift register circuits 11*a* and 11*b*, two latch circuits 12*a* and 12*b*, one gate circuit 13A, three level shift circuits 14A, and one output circuit 15A.

Each gate circuit 13A-1, 13A-2, etc. consists of three two-input NAND circuits 134–136 and one inverter 137. With signals T1 and T3, a logic operation is performed to generate signals S1–S3.

One input of two-input NAND circuit 134 in gate circuit 13A-1 is connected to the input terminal for signal T1 through input buffer circuit B7, and the other input is connected to the output of latch circuit 12*a*-1. Its output is connected to one input of two-input NAND circuit 136 and to the input of inverter 137.

One input of two-input NAND circuit 135 is connected the input terminal for signal T3 through input buffer circuit B8, and the other input is connected to the output of latch circuit 12*b*-1. Its output is connected to the other input of two-input NAND circuit 136 and to input terminal IN of level shift circuit 14A-13.

The output of two-input NAND circuit 136 is connected to input terminal IN of level shift circuit 14A-11, and the output of inverter 137 is connected to input terminal IN of level shift circuit 14A-12 and to one input of output circuit 15A-1.

Signal S1 is output from two-input NAND circuit 136, signal S2 is output from the output of inverter 137, and signal S3 is output from two-input NAND circuit 135.

One input of two-input NAND circuit 134 in gate circuit 13A-2 is connected to the input terminal for signal T1 through input buffer circuit B7, and the other input is connected to the output of latch circuit 12*a*-2. Its output is connected to one input of two-input NAND circuit 136 and to the input of inverter 137.

One input of two-input NAND circuit 135 is connected to the input terminal for signal T3 through input buffer circuit B8, and the other input is connected to the output of latch circuit 12*b*-2. Its output is connected to the other input of two-input NAND circuit 136 and to input terminal IN of level shift circuit 14A-23.

The output of two-input NAND circuit 136 is connected to input terminal IN of level shift circuit 14A-21, and the output of inverter 137 is connected to input terminal IN of level shift circuit 14A-22 and to one input of output circuit 15A-2.

Signal S11 is output from two-input NAND circuit 136, signal S12 is output from the output of inverter 137, and signal S13 is output from two-input NAND circuit 135.

For level shift circuit 14A-11 (L/S), when signal S1 is input at the high level ($V_{DD}$ level) to input terminal IN, a high-level signal S1' is output from output terminal O1 to output circuit 15A-1.

Level shift circuit 14A-12 (L/S1) is a circuit for converting the logic level input signals (GND-$V_{DD}$) into full amplitude (GND-$V_H$) signals. When low-level (GND level) signal S2 is input to input terminal IN, signal S2' of high power-source level $V_H$ is output from inverting output terminal O1_ to output 15A-1. On the other hand, when high-level (power source voltage level $V_{DD}$) signal S2 is input to input terminal IN, ground (GND) level signal S2' is output from inverting output terminal O1_ to output 15A-1.

Level shift circuit 14A-13 (L/S1) is a circuit for converting the logic level input signals (GND-$V_{DD}$) into full amplitude (GND-$V_H$) signals. When low-level (GND level) signal S3 is input to input terminal IN, signal S3' of high power source voltage level $V_H$ is output from inverting output terminal O1_ to output 15A-1. On the other hand, when high-level (power source voltage level $V_{DD}$) signal S3 is input to input terminal IN, ground (GND) level signal S3' is output from inverting output terminal O1_ to output 15A-1.

For level shift circuit 14A-21 (L/S), when signal S11 is input at the high level ($V_{DD}$ level) to input terminal IN, a high-level signal S1" is output from output terminal O1 to output circuit 15A-2.

Level shift circuit 14A-22 (L/S1) is a circuit for converting the logic level input signals (GND-$V_{DD}$) into full amplitude (GND-$V_H$) signals. When low-level (GND level) signal S12 is input to input terminal IN, S2" of high power source voltage level $V_H$ is output from inverting output terminal O1_ to output 15A-2. On the other hand, when high-level (power source voltage level $V_{DD}$) signal S2 is input to input terminal IN, ground (GND) level signal S2" is output from inverting output terminal O1_ to output 15A-2.

Level shift circuit 14A-23 (L/S1) is a circuit for converting the logic level input signals (GND-$V_{DD}$) into full amplitude (GND-$V_H$) signals. When low-level (GND level) signal S13 is input to input terminal IN, signal S3" of high power source voltage level $V_H$ is output from inverting output terminal O1_ to output 15A-2. On the other hand, when high-level (power source voltage level $V_{DD}$) signal S3 is input to input terminal IN, ground (GND) level signal S3" is output from inverting output terminal O1_ to output 15A-2.

FIG. 2 is a circuit diagram illustrating a configuration example of a level shift circuit for converting a logic level (GND-$V_{DD}$) signal into a full amplitude (GND-$V_H$) signal.

As can be seen from FIG. 2, in this level shift circuit, a current-limiting circuit is formed by connecting current source Ie, PMOS transistor MP and NMOS transistor MN in series and by connecting resistors R1 and R2 as well as NMOS transistor MNIN in series between the feed line of high voltage $V_H$ and ground GND. Midpoint N1 of the connection between resistors R1 and R2 is connected to the gate of PMOS transistor MP. Input signal IN is fed to both the gate of NMOS transistor MNIN and the input of inverter INV, and the output of inverter INV is connected to the gate of NMOS transistor MN. Then, the level-shifted signal is output from midpoint O1 of the connection between the drain of PMOS transistor MP and the drain of NMOS transistor MN. Since the MOS transistors are thin-film transistors, their threshold voltages $V_{th}$ are in the range of 1–2 V.

Output circuits 15A-1 and 15A-2 have the circuit configuration illustrated in FIG. 3. Corresponding to the input levels of signals S2 and S1'–S3' as well as S12 and S1"–S3", a scan pulse or a holding pulse is output from output terminal HVO.

As can be seen from FIG. 3, output circuit 15A-1 or 15A-2 consists of diodes D1–D16, high-voltage-rating diodes DH1 and DH2, thin-film-gate NMOS transistors XSU, XSD, and XSC with high drain voltage rating, as well as thin-film-gate PMOS transistor XPU with a high drain voltage rating.

Diodes D1–D7 are connected in series. The anode of diode D1 is connected to both connection terminal OSU and the gate of NMOS transistor XSU, and the cathode of diode D7 is connected to the source of NMOS transistor XSU. The anode of diode D8 is connected to the midpoint of the connection between the cathode of diode D7 and the source of NMOS transistor XSU, and the cathode of diode D8 is connected to the midpoint of connection between the anode of diode D1 and connection terminal OSU as well as the gate of NMOS transistor XSU.

The drain of NMOS transistor XSU is connected to the cathode of high-voltage-rating diode DH1, and the anode of high-voltage-rating diode DH1 is connected to connection terminal VSU of discrete portion 2A.

In addition, connection terminal OSU is connected to inverting output terminal O1_ of level shift circuit 14A-12 or 14A-22.

Diodes D9–D15 are connected in series. The anode of diode D9 is connected to both connection terminal PSD and the gate of NMOS transistor XSD, and the cathode of diode D15 is connected to the source of NMOS transistor XSD. The anode of diode D16 and the anode of high-voltage-rating diode DH2 are connected to the midpoint of the connection between the cathode of diode D15 and the source of NMOS transistor XSD, and the cathode of diode of D16 is connected to the midpoint of the connection between the anode of diode D9 and connection terminal PSD as well as the gate of NMOS transistor XSD.

The drain of NMOS transistor XSD is connected to the source of NMOS transistor XSU, and the cathode of high-voltage-rating diode DH2 is connected to connection terminal VSD of discrete portion 2A.

In addition, connection terminal PSD is connected to inverting output terminal O1_ of level shift circuit 14A-13 or 14A-23.

The drain of PMOS transistor XPUL and the drain of NMOS transistor XSC are connected. The midpoint of the connection between the latter [two transistors] is connected to the midpoint of the connection between the source of NMOS transistor XSU and the drain of NMOS transistor XSD. The midpoint is also connected to output terminal HVO.

The source of PMOS transistor XPUL is connected to the feed line of high power source voltage $V_H$, and its gate is connected to connection terminal PUL. Connection terminal PUL is connected to output terminal O1 of level shift circuit 14-11 or 14-21.

The source of NMOS transistor XSC is connected to ground line GND, and its gate is connected to connection terminal OSC. Connection terminal OSC is connected to the output of inverter 137 in gate circuit 13A-1 or 13A-2.

In FIG. 3, since all of the MOS transistors are thin-film MOS transistors, their threshold voltages $V_{th}$ are in the range of 1–2 V.

Discrete portion 2A consists of level shift circuit (L/S) 21, buffer circuits BP21 and BN21, PMOS transistor EXP21 for pull-up, as well as NMOS transistor EXN21 for pull-down.

Level shift circuit (L/S) 21 has two output terminals O1 and O2. When a high-level signal T2 is input to input terminal IN, high-level signals almost equal to the power source voltages of buffer circuits BP21 and BN21 are output from output terminals O1 and O2, respectively.

The gate of PMOS transistor EXP21 is connected to output terminal O1 of level shift circuit 21 through buffer circuit BP21; its source is connected to the feed line of high power source voltage $V_H$; and its drain is connected to connection terminal VSU of IC portion 1A.

The gate of NMOS transistor EXN21 is connected to output terminal O2 of level shift circuit 21 through buffer circuit BN21; its source is connected to ground line GND; and its drain is connected to connection terminal VSD of IC portion 1A.

In the following, the operation of the display-panel drive circuit having the configuration will be explained with reference to the timing chart shown in FIG. 4.

In the circuit, data signal D1 is the data for generating the scan pulse which should be applied on a prescribed cathode line at the beginning of plasma discharge. Data signal D1 is also the data which controls NMOS transistors XSU and XSC in output circuit 15A-1 or 15A-2 illustrated in FIG. 3.

Data signal D2 is the data for generating the holding pulse which should be applied on a prescribed cathode line after two discharge cycles. It is also the data which controls NMOS transistors XSU and XSD in output circuit 15A-1 or 15A-2.

Data signals D1 and D2 are serial/parallel converted in level shift circuits **11*a* and 11*b* as well as in latch circuits 12*a* and 12*b***.

Data signals D1 and D2 are fed to level shift circuits **11*a* and 11*b* depending on clock signals CKD1 and CKD2, respectively. Then, based on the input of signals of LED1 and LED2, data D1 and D2 are held in latch circuits 12*a* and 12*b***, respectively.

In gate circuit 13A, logic operations are performed with respect to the data held in latch circuits **12*a* and 12*b* as well as signals T1 and T3. As a result, three signal waveforms represented by S1, S2, and S3 are generated, as illustrated in FIG. 4**.

Generated by gate circuit 13A-1, signal S1 is input to level shift circuit 14A-11; signal S2 is input to both connection terminal OSC of output circuit 15A-1 and level shift circuit 14A-12; and S3 is input to level shift circuit 14A-13.

Similarly, generated by gate circuit 13A-2, signal S1 is input to level shift circuit 14A-21; signal S2 is input to both connection terminal OSC of output circuit 15A-2 and level shift circuit 14A-22; and S3 is input to level shift circuit 14A-23.

In various level shift circuits 14A-11–14A-13 and 14A-21–14A-23, level-conversion is performed with respect to the input signals. Then, as illustrated in FIG. 4, a signal waveform represented by S1' is output from level shift circuit 14A-11 to connection terminal PUL of output 15A-1; a signal waveform shifted by S2' is output from level shift circuit 14A-12 to connection terminal OSU of output circuit 15A-1; and a waveform represented by S3' is output from level shift 14A-13 to connection terminal PSD of output circuit 15A-1.

Figure 4:
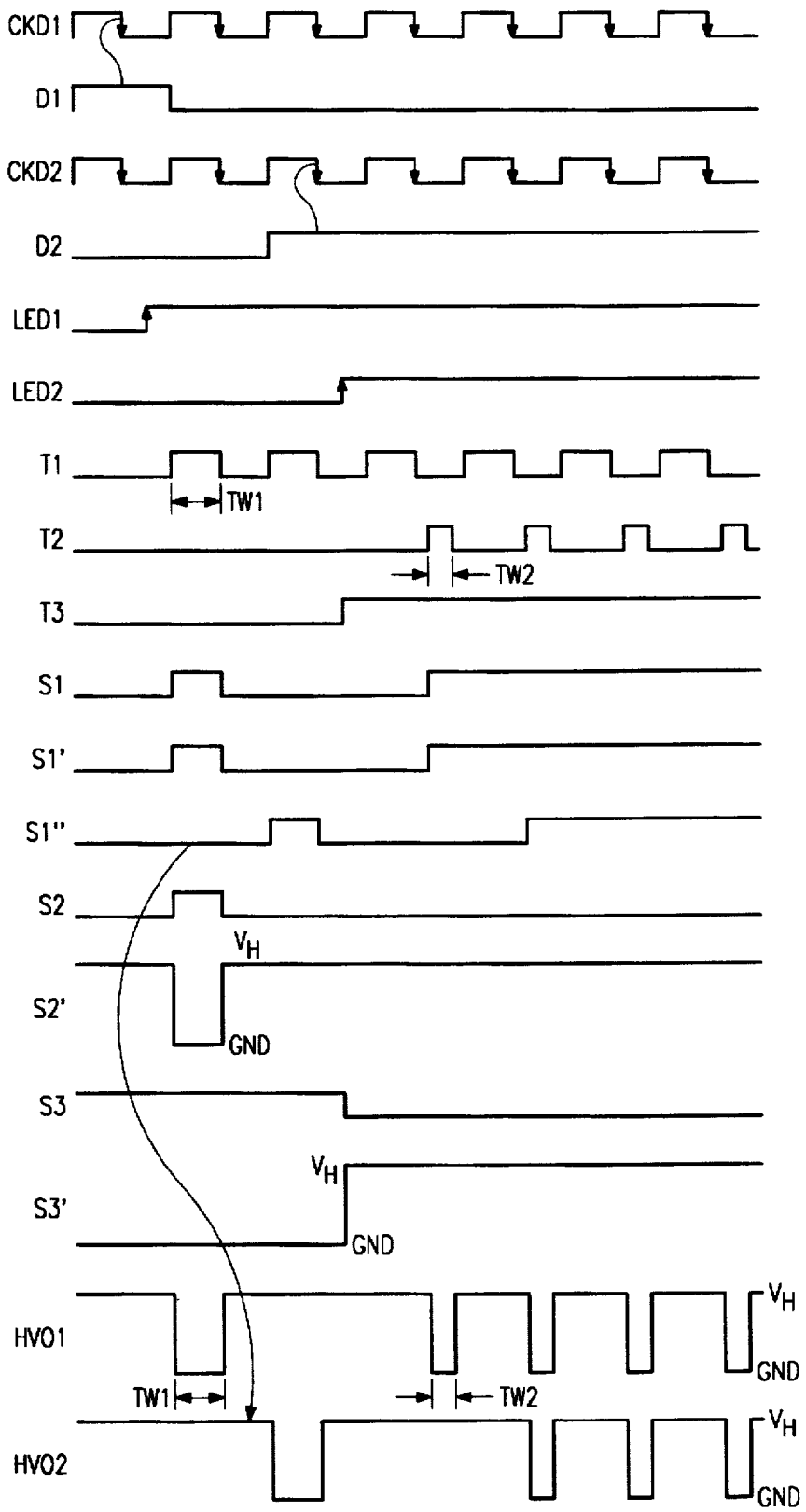
FIG. 4 is a timing chart of the operation of the circuit of FIG. 1.

Similarly, as can be seen from FIG. 4, a signal waveform represented by S1" having [the same form as that of S1' and]

a prescribed phase difference from S1' is output from level shift circuit 14A-21 to connection terminal PUL of output 15A-2. Also, a signal S2" having the same form as that of S2' and a prescribed phase difference from S2' is output from level shift circuit 14A-22 to connection terminal OSU of output circuit 15A-2. A waveform S3" having the same form as that of S3' and a prescribed phase difference from S3' is output from level shift 14A-23 to connection terminal PSD of output circuit 15A-2.

In this case, for example, when data signal D1 is high and data signal D2 is low, with timing corresponding to the high level of signal T1, signals S1, S2, and S3 go high. As a result, signal S1' is input to output circuit 15A-1 at the high level of the high power source voltage level $V_H$. In addition, signals S2' and S3' are input to output circuit 15A-1 at the low level of the ground level.

Consequently, in output circuit 15A-1, among the elements constituting a so-called totem pole circuit, NMOS transistor XSC remains on; NMOS transistor XSU remains off; and NMOS transistor XSD as well as PMOS transistor XPUL also remain off.

As a result, output terminal HVO is pulled to the ground level, and a scan pulse is generated.

As data signal D1 is transmitted to shift register circuit 11*a*, the scan pulse is output with a prescribed phase difference.

As far as the output of the holding pulse is concerned, data signal D2 determines the output terminal HVO from which the holding pulse is output.

When data signal D2 is on the high level (data signal D1 is on the low level at this time), with timing corresponding to the high level of signal T3, signal S3 is switched to low level. At this time, signal S1 is switched to high level, and signal S2 is on the low level.

As a result, signal S1' is on the high level and is input to connection terminal PUL of output circuit 15A-1. In addition, signals S2' and S3' are on high power source voltage level $V_H$ and are input to connection terminals OSU and PSD of output circuit 15A-1, respectively.

In this way, in output circuit 15A-1, NMOS transistors XSC and XPUL remain off, and NMOS transistors XSU and XSD remain on.

In discrete portion 2A, PMOS transistor EXP21 and NMOS transistor EXN21 are turned on and off alternately corresponding to the input of signal T2 to level shift circuit 21, and the holding pulse is output selectively.

Just as is the case of data signal D1 of the scan pulse, as data signal D2 is transmitted to the shift register circuit, the holding pulse is output from output terminal HVO with a prescribed phase difference.

In addition, when output terminal HVO1 performs a scanning operation, output terminal HVO2 may be coupled with output terminal HVO1 due to the capacitance between output terminals HVO1 and HVO2. This problem, however, can be prevented as PMOS transistor XPUL is held on with a timing other than timing T1 of the scan pulse and timing T3 of the holding pulse.

As described above, when the holding pulse is input, PMOS transistor XPUL and NMOS transistor XSC in output circuit 15A remain off, and NMOS transistors XSU and XSD are operated appropriately so that they remain on constantly.

At this time, as the outputs of level shift circuits 14A-12 and 14A-13, signals S2' and S3' on high power source voltage level $V_H$ are applied to connection terminals OSU and OSC which are connected to NMOS transistors XSU and XSD, respectively.

As a result, forward currents flow through diodes D1–D7 and through D9–D15. In addition, the voltages $V_{GS}$ between the gate and source of NMOS transistor XSU as well as between the gate and source of NMOS transistor XSD are constantly kept around 5 V.

As a result, for example, assuming that the signal at output terminal HVO1 is on the low level, when attached PMOS transistor EXP21 remains on and the voltage at connection terminal VSU is pulled up to the high power source voltage level $V_H$, since NMOS transistor XSU is always on, the source, drain, and gate of NMOS transistor XSU have almost the same potential difference. At the same time, the voltage at output terminal HVO1 is pulled up until it almost reaches the level of $[V_H-V_{TN}-\alpha]$. $V_{TN}$ is the threshold voltage of the NMOS transistor, and $\alpha$ is the ON voltage of the level shift circuit.

At this time, since attached NMOS transistor EXN21 is off, the voltage levels at drain/gate/source of NMOS transistor XSD are also increased in the same way as output terminal HVO1.

In this case, during the pull-up operation, with respect to the capacitive load of output terminal HVO, the power ratings of IC portion 1A and discrete portion 2A in FIG. 3 can be calculated ideally from the following formula.

$$A/2C_L-V_H^2=(I_2\times V_{DIODE}+I_1\times\Delta V_{DS(XSU)}+I_1\times V_{DH1})+I_1\times\Delta_{DS(EXP21)} \quad (3)$$

where $V_{diode}$ is the forward voltage on diodes D1–D7, which is about 5 V; $\Delta V_{DS(XSU)}$ is the voltage between the drain and source of NMOS transistor XSU; $V_{DH1}$ is the forward voltage on high-voltage-rating diode DH1, which is about 0.7 V; and $\Delta V_{DS(EXP21)}$ is the voltage between the drain and source of PMOS transistor EXP21 in discrete portion 2A when the PMOS transistor is switched.

As can be seen from said formula 3, the power rating ratio between IC portion 1A and discrete portion 2A is determined approximately by $V_{DS(XSU)}$, which is the voltage between the drain and source of NMOS transistor XSU, and by $V_{DS(EXP21)}$, which is the voltage between the drain and source of PMOS transistor EXP21 when it is switched.

Figure 5:
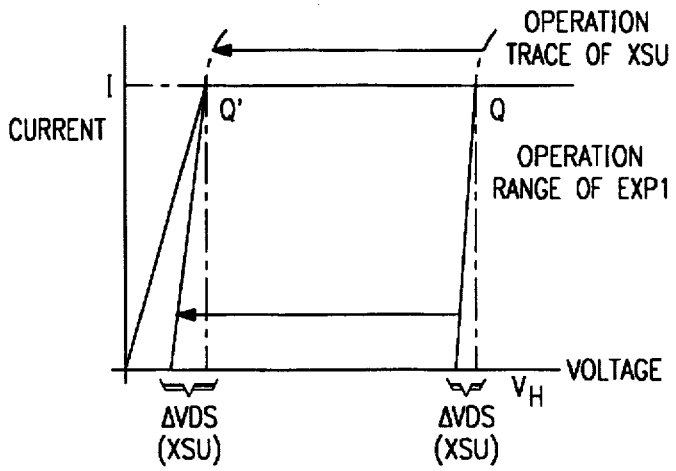
FIG. 5 is a diagram for explaining the operation of the circuit of FIG. 1 when holding pulses are generated.

In this case, when the capability of the element of NMOS transistor XSU is designed to be much better than that of PMOS transistor EXP21, as illustrated in FIG. 5, it is possible to have NMOS transistor XSU always operate in the unsaturated region, and to have PMOS transistor EXP21 operate alternately in the saturated region and the unsaturated region. That is, the operating characteristic curve of NMOS transistor XSU shifts left/right in FIG. 5 corresponding to the drain potential.

Consequently, the relationship shown by the following formula can be satisfied.

$$\Delta V_{DS(XSU)}\leqq\Delta V_{DS(EXP21)}$$

Similarly, when the pull-down situation is taken into consideration, when the capability of the element properties of NMOS transistor XSD is designed to be much better than that of NMOS transistor EXN21, it is possible to have NMOS transistor XSD always operate in the unsaturated region, and to have NMOS transistor EXN21 operate alternately in the saturated region and unsaturated region. Consequently, the relationship shown by the following formula can be satisfied.

$$\Delta V_{DS(XSD)}\leqq\Delta V_{DS(EXN21)} \quad (5)$$

where $\Delta V_{DS(XSD)}$ is the voltage between the drain and source of NMOS transistor XSD, and $\Delta V_{DS(EXN21)}$ is the voltage between the drain and source of NMOS transistor EXN21 when it is switched.

The absolute power rating [$CV^2$–f] is divided at a ratio of about 2:8 according to the ratio of $\Delta V_{DS(XSU)}$ to $\Delta V_{DS(EXP21)}$ and the ratio of $\Delta V_{DS(XSU)}$ to $\Delta V_{DS(EXN21)}$. Consequently, the power rating in the driver IC can be reduced to about 2 W, which is about 20% of 9.6 W, the power rating in the conventional circuit.

In addition, since NMOS transistors XSU and XSD in the floating state are adopted with respect to each output terminal HVO, the holding pulses can be output with a prescribed phase difference from each other.

As explained above, according to this invention, the display-panel drive circuit consists of monolithic IC portion 1A and discrete portion 2A. The purpose of adopting such configuration is to ensure that the power rating can be divided. As a result, it is possible to limit the power rating of the IC portion to as low as about 2 W determined by the restriction of the package, etc.

In addition, since NMOS transistors XSU and XSD in the floating state are adopted with respect to each output terminal HVO, the holding pulses can be output with a prescribed phase difference from each other.

In the application example, explanation is made with respect to a drive circuit for cathode electrodes. It is easy to transform the drive circuit disclosed in this application example into a drive circuit for anode electrodes. That is, by taking signal D1 as an image data signal and by fixing signal D2 on GND level, the drive circuit disclosed in the application example can be transformed into a drive circuit for anode. In this case, it is also possible to realize a low power rating for the IC portion.

Figure 6:
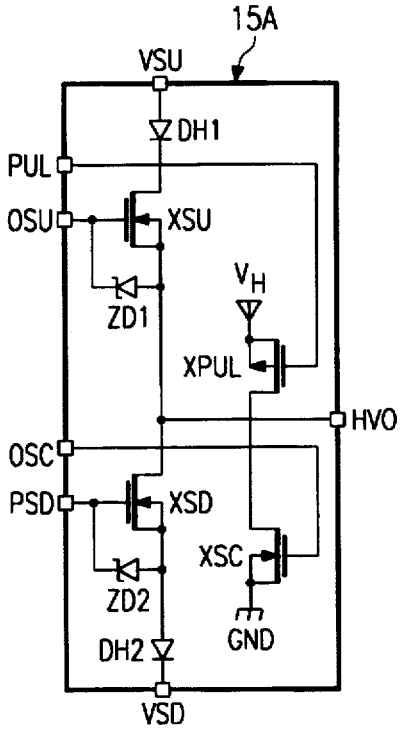
FIG. 6 is a circuit diagram of a second embodiment of an output circuit for this invention.

FIG. 6 is a circuit diagram illustrating another configuration example of the output circuit of this invention.

The difference between this circuit and the circuit shown in FIG. 3 is that, in this case, Zener diodes ZD1 and ZD2 are used as the substitutions for diodes D1–D8 and D9–D16 in the circuit illustrated in FIG. 3, respectively.

Other portions of this circuit are identical to those of the circuit illustrated in FIG. 3. In addition, this circuit also has the same functions and effects as the circuit shown in FIG. 3.

Figure 7:
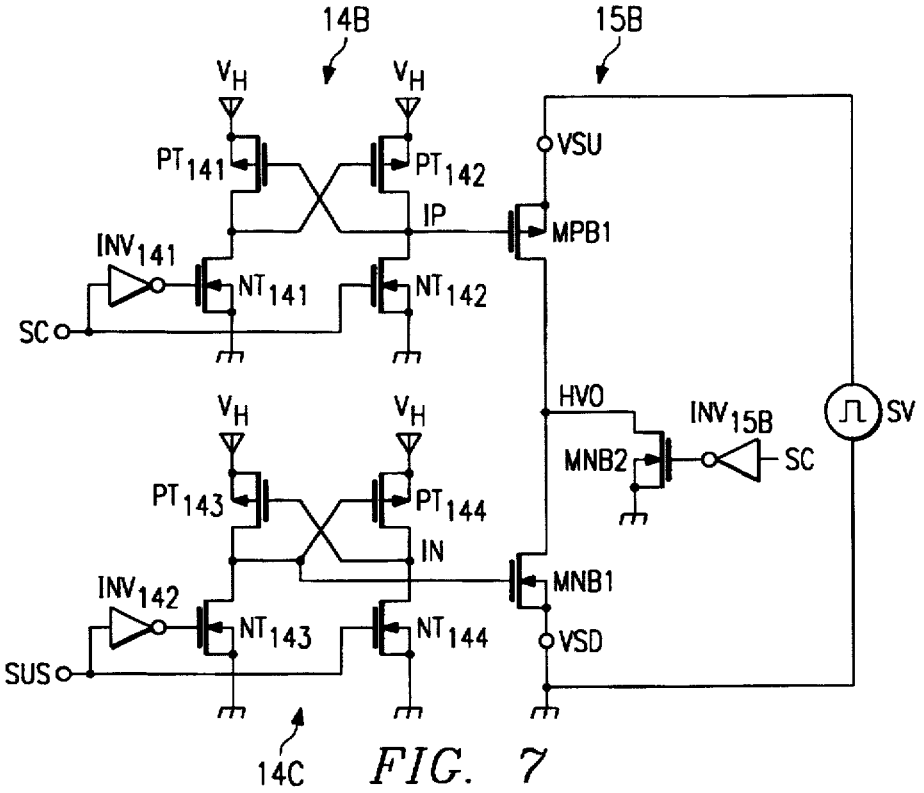
FIG. 7 is a circuit diagram illustrating another embodiment of a level shift circuit and output circuit for this invention.

FIG. 7 is a circuit diagram illustrating another configuration example of the output circuit and the level shift circuit connected to the output circuit of this invention.

In FIG. 7, 14B and 14C represent level shift circuits, and 15B represents an output circuit.

Level shift circuit 14B consists of PMOS transistor $PT_{141}$, NMOS transistor $NT_{141}$, PMOS transistor $PT_{142}$, NMOS transistor $NT_{142}$, and inverter $INV_{141}$. Signal SC is fed to the gate of NMOS transistor $NT_{142}$, and this signal is also fed to the gate of NMOS transistor $NT_{141}$ through inverter $INV_{141}$.

Similarly, level shift circuit 14C consists of PMOS transistor $PT_{143}$, NMOS transistor $NT_{143}$, PMOS transistor $PT_{144}$, NMOS transistor $NT_{144}$, and inverter $INV_{142}$. Signal SUS is fed to the gate of NMOS transistor $NT_{144}$, and this signal is also fed to the gate of NMOS transistor $NT_{143}$ through inverter $INV_{142}$.

Output circuit 15B consists of the following elements: PMOS transistor MPB1 and NMOS transistor MHB1 which are connected in series between connection terminals VSU and VSD; NMOS transistor MNB2 connected between the ground line and output terminal HVO, which is formed at the midpoint of the connection between PMOS transistor MPB1 and NMOS transistor MHB1; and inverter $INV_{15B}$ which inverts the level of signal SC and feeds the signal to the gate of NMOS transistor MNB2.

In the circuits, PMOS transistors $PT_{141}$ and $PT_{142}$ in level shift circuit 14B, PMOS transistors $PT_{143}$ and $PT_{144}$ in level shift circuit 14C, as well as PMOS transistor MPB1 and NMOS transistor MNB1 in output circuit 15B are all thick-film-gate MOS transistors with high voltage rating.

Signals are input to connection terminals VSU and VSD from signal source SV.

In the configuration, for example, when the voltage at connection terminal VSU is pulled up, the potential at connection terminal VSD is pulled down from gate input [voltage] IN by an amount of $V_T$, the threshold voltage of NMOS transistor MNB1.

In the same way, when pull-down operation takes place, the potential at connection terminal VSU is pulled up from gate input IP by an amount of $V_T$, which is the threshold voltage of MPB1.

Consequently, in this case, variations in drain/source voltages $V_{DS}$ Of NMOS transistor MNB1 and PMOS transistor MPB1 are larger than those in the circuits illustrated in FIGS. 1 and 3.

This is because the threshold voltage of the thick-film-gate MOS transistor is larger than that of the thin-film-gate MOS transistor. In addition, the layout area also becomes large.

However, since level shift circuits 14B and 14C are so-called latch-type circuits, it is still possible to realize a low power rating.

As explained above, according to this invention, the power rating is reduced so that formation of an IC is possible.

In addition, the second pulse signals can be output with a prescribed phase difference from each other.

I claim:

1. A display-panel drive circuit comprising:

a first shift register group of multiple primary shift registers which shift a first pulse signal in sequence in response to a first clock signal;

a second shift register group having multiple secondary shift registers which shift a second pulse signal in sequence in response to a second clock signal;

a first transistor group of multiple coupling transistors (XSC) which respectively couple output terminals of an output terminal group to a ground potential in response in outputs of the primary shift registers;

a second transistor group having multiple primary terminal transistors (XSU) which respectively couple the output terminals of the output terminal group to a first connection terminal (VSU);

a third transistor group having multiple secondary terminal transistors (XSD) which respectively couple the output terminals of the output terminal group to a second connection terminal in response to the outputs of the secondary shift registers; and a pull-down transistor which couples the second connection terminal to the ground potential in response to a pulse signal (T2), and a pull-up transistor which couples the first connection terminal to a high power source voltage, wherein the drive circuit has a fourth transistor group of multiple transistors which respectively couple the output terminals of the output terminal group to the high power source voltage when the coupling transistors in the first transistor group and the secondary terminal transistors in the third transistor group are nonconductive.

2. The drive circuit of claim 1 wherein the output terminals of the output terminal group are adapted to be coupled to respective cathode electrodes of a plasma display panel so that (i) making the coupling transistors of the first transistor group conductive applies scan pulses having a prescribed phase difference to the cathode electrodes, and (ii) making a complementing transistor conductive applies holding pulses having a prescribed phase difference to the cathode electrodes.

3. The display-panel drive circuit described in claim 1 wherein the first and second shift register groups, the first, second, third and fourth transistor groups are all formed in the same semiconductor IC device.

4. A display-panel drive circuit comprising:

a first shift register group of multiple primary shift registers which shift a first pulse signal in sequence in response to a first clock signal;

a second shift register group having multiple secondary shift registers which shift a second pulse signal in sequence in response to a second clock signal;

a first transistor group of multiple coupling transistors (XSC) which respectively couple output terminals of an output terminal group to a first reference potential in response to outputs of the primary shift registers;

a second transistor group having multiple primary terminal transistors (XSU) which respectively couple the output terminals of the output terminal group to a first connection terminal (VSU);

a third transistor group having multiple secondary terminal transistors (XSD) which respectively couple the output terminals of the output terminal group to a second connection terminal (VSD) in response to the outputs of the secondary shift registers; and a pull-down transistor which couples the second connection terminal to the first reference potential in response to a pulse signal (T2), and a pull-up transistor which couples the first connection terminal to a second reference potential, wherein the drive circuit has a fourth transistor group of multiple transistors which respectively couple the output terminals of the output terminal group to the second reference potential when the coupling transistors in the first transistor group and the secondary terminal transistors in the third transistor group are nonconductive.

5. The drive circuit of claim 4 wherein the output terminals of the output terminal group are adapted to be coupled to respective cathode electrodes of a plasma display panel so that (i) making the coupling transistors of the first transistor group conductive applies scan pulses having a prescribed phase difference to the cathode electrodes, and (ii) making a complementing transistor conductive applies holding pulses having a prescribed phase difference to the cathode electrodes.

6. The display-panel drive circuit described in claim 4 wherein the first and second shift register groups, the first, second, third and fourth transistor groups are all formed in the same semiconductor IC device.

* * * * *